US007427147B2

(12) United States Patent
Kovacs

(10) Patent No.: US 7,427,147 B2
(45) Date of Patent: Sep. 23, 2008

(54) LIGHTING ASSEMBLIES

(75) Inventor: Laurence Kovacs, West Midlands (GB)

(73) Assignee: FPC (UK) Limited, West Midlands (GB)

( * ) Notice: Subject to any disclaimer, the term of this patent is extended or adjusted under 35 U.S.C. 154(b) by 98 days.

(21) Appl. No.: 11/303,401

(22) Filed: Dec. 16, 2005

(65) Prior Publication Data

US 2007/0068099 A1 Mar. 29, 2007

(30) Foreign Application Priority Data

Aug. 8, 2005 (GB) ..... 0516259.9

(51) Int. Cl.
*F21V 29/00* (2006.01)

(52) U.S. Cl. ..... 362/294; 362/373

(58) Field of Classification Search ..... 362/147, 362/362, 294, 373; 52/232
See application file for complete search history.

(56) References Cited

U.S. PATENT DOCUMENTS

| | | | | |
|---|---|---|---|---|
| 7,059,092 | B2 * | 6/2006 | Harkins et al. | 52/232 |
| 2005/0174781 | A1 * | 8/2005 | Howe | 362/294 |
| 2007/0109796 | A1 * | 5/2007 | Johnson | 362/373 |
| 2007/0206374 | A1 * | 9/2007 | Petrakis et al. | 362/147 |

* cited by examiner

*Primary Examiner*—Sandra O'Shea
*Assistant Examiner*—James W Cranson
(74) *Attorney, Agent, or Firm*—Smith-Hill and Bedell

(57) ABSTRACT

A light assembly comprising a hollow section for a light element, the hollow section including an intumescent surface presented to expand upon activation substantially horizontally across the hollow section.

55 Claims, 4 Drawing Sheets

LIGHTING ASSEMBLIES

This application claims priority under 35 U.S.C. 119 of United Kingdom Patent Application No. 0516259.7 filed Aug. 8, 2005.

The present invention relates to lighting assemblies and more particularly to downlighter assemblies and means for providing a fire rated barrier with such assemblies.

In order to meet fire regulations it is important that an appropriate barrier is created to contain and restrict fire, smoke and oxygen inflow between rooms, corridors and ducting of a building in order to contain a fire once ignited. It will be understood most rooms incorporate a number of openings in addition to doors and windows through which fire and smoke can pass. These openings include ventilators and light fittings. A popular form of light fitting is commonly referred to as a downlighter.

Downlighters are essentially embedded within a ceiling or roof structure so that their intrusion into the room is reduced. Unfortunately downlighters generally comprise an open or well ventilated casing to accommodate the heat created by operation of the lighting lamp and the opening in the ceiling will generally be simply closed by a glass cover or mostly filled by a bulb. In such circumstances these downlighters create openings which in themselves are inadequate for fire barrier protection.

Intumescent materials swell and rapidly expand upon reaching a specified temperature. In such circumstances intumescent materials have been used previously to close apertures such as ventilators and other openings in barriers or walls. Intumescent materials have also been used with regard to light fittings previously but it will be understood that care must be taken with these intumescent materials in order to ensure that the normal heating from the light in the lamp does not create problems with respect to the intumescent material whilst ensuring that the intumescent material reacts quickly enough to form a smoke and fire barrier.

In accordance with certain aspects of the present invention there is provided a light assembly comprising a hollow section for a light element, the hollow section including an intumescent surface presented to expand upon activation substantially horizontally across the hollow section.

Also in accordance with certain aspects of the present invention there is provided a hollow section for a lighting assembly, the section comprising an intumescent surface presented to expand upon activation substantially horizontally across the hollow section.

Typically, the intumescent surface comprises a layer of intumescent material secured to the hollow section. Normally, the intumescent surface is secured by an adhesive. Alternatively, or additionally, the intumescent surface is secured by a mechanical fixing. Typically, the mechanical fixing comprises a rivet or screw or tape or stitching between the intumescent surface and the hollow section.

Typically, the hollow section is formed from a fire resistant material. Possibly, the fire resistant material is a metal or ceramic moulded or cast or otherwise formed to provide a hollow section.

Generally, the intumescent surface comprises a collar within the hollow section. Possibly, the hollow section incorporates more than one collar at axially displaced parts of the hollow section.

Possibly, the intumescent surface is formed in a rebate groove within the hollow section. Possibly, the rebate groove aids horizontal expansion across the hollow section.

Generally, the hollow section includes fixings to secure the hollow section about a mounting aperture in a surface. Generally, the fixings have a bias towards compressive engagement with the surface. Possibly, the bias is provided by a spring. Advantageously, the fixings comprise interference clips outwardly expanding from the hollow section to engage the surface.

Possibly, the hollow section is open at both ends. Alternatively, the hollow section is closed at one end. Advantageously, the hollow section includes ventilation apertures. Advantageously, the intumescent surface is provided adjacent to any opening or aperture in the hollow section.

Advantageously, the hollow section includes an intumescent feature provided upon an outside surface of the hollow section. Generally, the intumescent feature acts upon expansion about the exterior of the hollow section.

Advantageously, the intumescent surface upon expansion acts against the bias, when present, to present a compressive seal barrier about the mounting aperture.

Additionally, the intumescent feature upon expansion acts against the resilience of the fixings to present a compressive seal about the mounting aperture.

Potentially, the intumescent feature is secured to or about the fixings.

Possibly, the hollow section is integral with a light fitting or fitment. Alternatively, the hollow section is secured around a light fitting or fitment. Additionally, the hollow section has an interference association with a light fitting.

Embodiments of the present invention will now be described by reference to the accompanying drawings in which.

Figure 1:
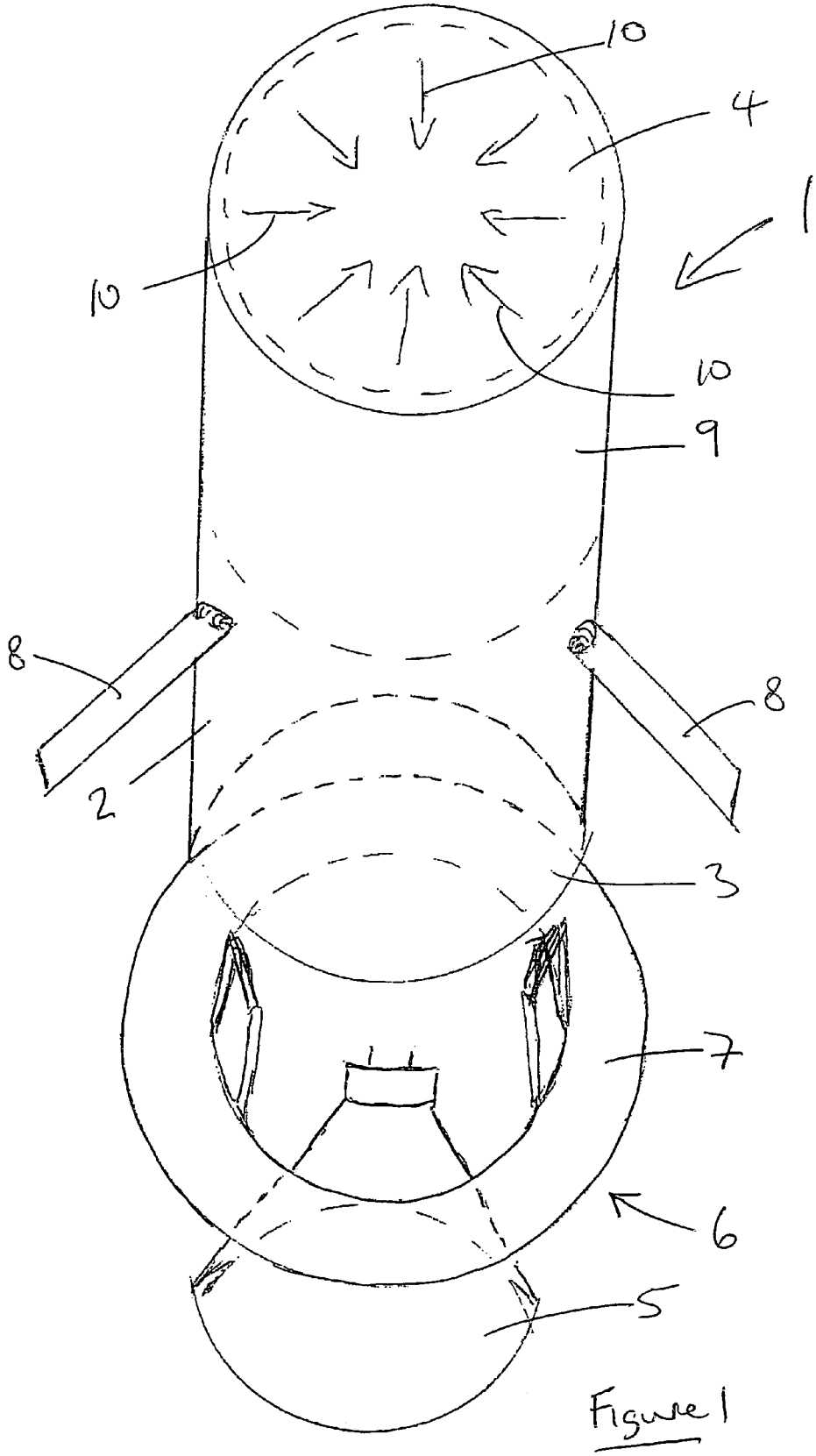
FIG. 1 illustrates a lighting assembly in which a hollow section is open at both ends.

Certain aspects of the present assembly provide a fire rated downlight that prevents the passage of fire through openings cut into ceilings for the installation of downlights.

The fire rated downlight incorporates a number of distinct points.

The fire rated downlight main body consists of a hollow section, preferably round but can be other types, e.g. square, triangular, hexagonal, octagonal or any shape that maintains a hollow section.

This section can be made of any material that will withstand heat for the required standard needed, e.g. 30 minutes, 60 minutes etc., without deteriorating, bearing down, melting or distorting from its original shape.

The preferred material will be metal.

The top of the hollow section may be closed or closed with a number of cut-outs in the top for ventilation purposes, these cut-outs may be circular, square, rectangular or any shape that allows for ventilation from the inside of the hollow section to the outside.

The top may be completely open for maximum ventilation purposes.

The bottom may have a thread for securing the light bulb assembly into, or holes for mechanically fixing the light bulb assembly to, or plain for welding the light bulb assembly to or gluing together, or shaped for crimping to the light assembly or tapered for a push-fit connection.

The hollow section may at the bottom have a minimum of two outward projecting lugs opposite each other or a multitude of outward projecting lugs. The projecting lugs may be part of the main body of the hollow section or fixed to the main body of the hollow section by any means, e.g. welded, screwed, riveted, glued etc. The projection acts as locking fixings by the upper face of the projection locking against the lower surface of the ceiling structure for the hollow section by means of the upward pressure created by the operation of the springs attached to the hollow section.

The lugs prevent the hollow section from lifting past the ceiling structure from the pressure exerted by the springs or from tilting or tipping over causing any flames/fire or heat to breach the ceiling structure when the light bulb assembly distorts or starts to melt.

The hollow section may have a projection/lug for an earthing connection to be attached directly to, or may have a projection/lug for a terminal block to be attached to which would allow the power connections and an earthing connection to be connected. This projection may be part of the main body of the hollow section, or fixed to the main body of the hollow section by any means e.g. welded, screwed, riveted, glued etc. The earthing connection to terminal block may be encased in a cover.

Attached to this hollow section will be a minimum of two spring fasteners at opposing sides, there may be multiple springs around the hollow section. The springs will be angled for downward acting pressure to press against the top face of the ceiling structure, e.g. plasterboard, to exert an upward lifting pressure on the hollow section.

Fixed to the bottom of the hollow section will be the assembly (light bulb assembly) that the bulb attaches to. This assembly can be any shape, round, square, triangular etc.

The assembly's size will be such that the uppermost surface projects past the outside diameter of the hollow section and mates with the underside of the ceiling structure, e.g. plasterboard.

The action of the springs exerts an upward lift of the assembly so that it is forced upwards to mate with the underside of the ceiling structure.

This assembly can be fixed to the hollow section by a variety of means, it can be mechanically fixed, e.g. screwed, riveted, welded, crimped, screwed with locking lugs, glued etc.

The hollow section will contain an intumescent (any material/product that expands when heated) layer or layers of sufficient thickness and depth to expand and seal across the inner hollow section for the amount of fire resistant time required. This intumescent can be fixed into place by a variety of means, glued, mechanically fixed, e.g. screwed, riveted, double sided tape, or it can rest on an angled lip/lug projecting inwardly from the inside face of the hollow section. This angled projection may be pressed inwards out of the main body of the hollow section, or fixed to the side face of the hollow section by any means as previously described for the projection/lug or intumescent fixing.

FIG. 1 illustrates a first embodiment of a lighting assembly 1 in accordance with certain aspects of the present invention. The assembly 1 comprises a hollow section 2 which is generally open at both ends 3, 4 to allow good air flow and therefore release of heat generated by a lighting element such as a light bulb 5 secured in a mounting end 3 of the hollow section 2. The hollow section 2 may comprise a sleeve which extends over a lighting element assembly 6 which may be a standard downlighter or similar lighting fitment secured in a ceiling or otherwise within a building. This assembly 6 may include a flange 7 which extends either above or below a mounting surface in which the assembly 6 is secured. Alternatively, the hollow section 2 may be integrally formed or secured to the assembly 6 for installation within a mounting aperture in a surface such as a ceiling.

The hollow section 2 is held in place by fixings 8 which extend radially outward from the hollow section 2. These fixings 8 as illustrated comprise clips which are either sprung or include a mechanical spring or other bias to extend radially outwardly for engagement with the surface in order to secure the hollow section 2 in place. Normally at least two fixings 6 are provided so that in association with a compressive interference fit upon the assembly 6 the hollow section 2 is stably presented.

It will be understood that the assembly 6 with the bulb 5 in a mounting aperture in the surface is not closed and as indicated generally it is advantageous that there is the facility for air flow cooling in use. In such circumstances in accordance with the present assembly, an intumescent layer 9 is located on the inner surface of the hollow section 2. This intumescent layer 9 comprises intumescent material, which expands rapidly upon reaching a trigger temperature. Such expansion in the embodiment depicted in FIG. 1 is generally horizontal inwards of the hollow section 2. Thus, the open end 4 of the hollow section 2 will be closed by the intumescent surface 2 expanding inwardly in the direction of arrow heads 10.

The intumescent surface 9 generally comprises a collar which extends around the circumference of the hollow section 2. This collar may be a single element or formed by a number of segments appropriately secured within the hollow section 2. Furthermore, it will be understood that the intumescent surface may only extend for a proportion of the circumference of the hollow section 2 provided the expansion range of the intumescent surface is sufficient to extend across horizontally the hollow section 2.

By expansion across the hollow section 2 the intumescent surface closes the openings presented by the aperture in the mounting surface and the assembly 6 in order to create an acceptable fire barrier for regulatory requirements. In such circumstances the hollow section 2 will be formed from a fire resistant material. Such fire resistant materials include metals such as steel as well as ceramics. It is important that the hollow section 2 remains in place during the intumescent surface expansions, otherwise displacement will open the apertures in the mounting surface and the assembly 6 and break the fire barrier desired. In such circumstances the fixings 8 will be sufficiently robust to resist the force that is created by expansion and other factors in use.

The intumescent surface will typically be formed by securing through an adhesive or mechanical fixing such as rivets, screws, stitching or tape to the hollow section 2. Alternatively, the intumescent material may be sprayed or plastered upon the inner surface of the hollow section 2.

As indicated above the hollow section 2 may be integrally formed with an existing or standard light bulb assembly whereby the hollow section slides over the existing light bulb assembly. Alternatively, and in order to render an existing light bulb assembly as acceptable for fire regulations, the hollow section 2 may be a separate element into which the existing light bulb assembly is secured or placed. In such circumstances, as will be described later, the hollow section 2 will incorporate appropriate electrical couplings or pathways to enable existing electrical wiring to be secured to the hollow section which in turn will include wiring and electrical couplings to allow the existing standard light element fitting to be coupled through the hollow section 2 with the electrical power cables etc., for that light fitting.

Figure 2:
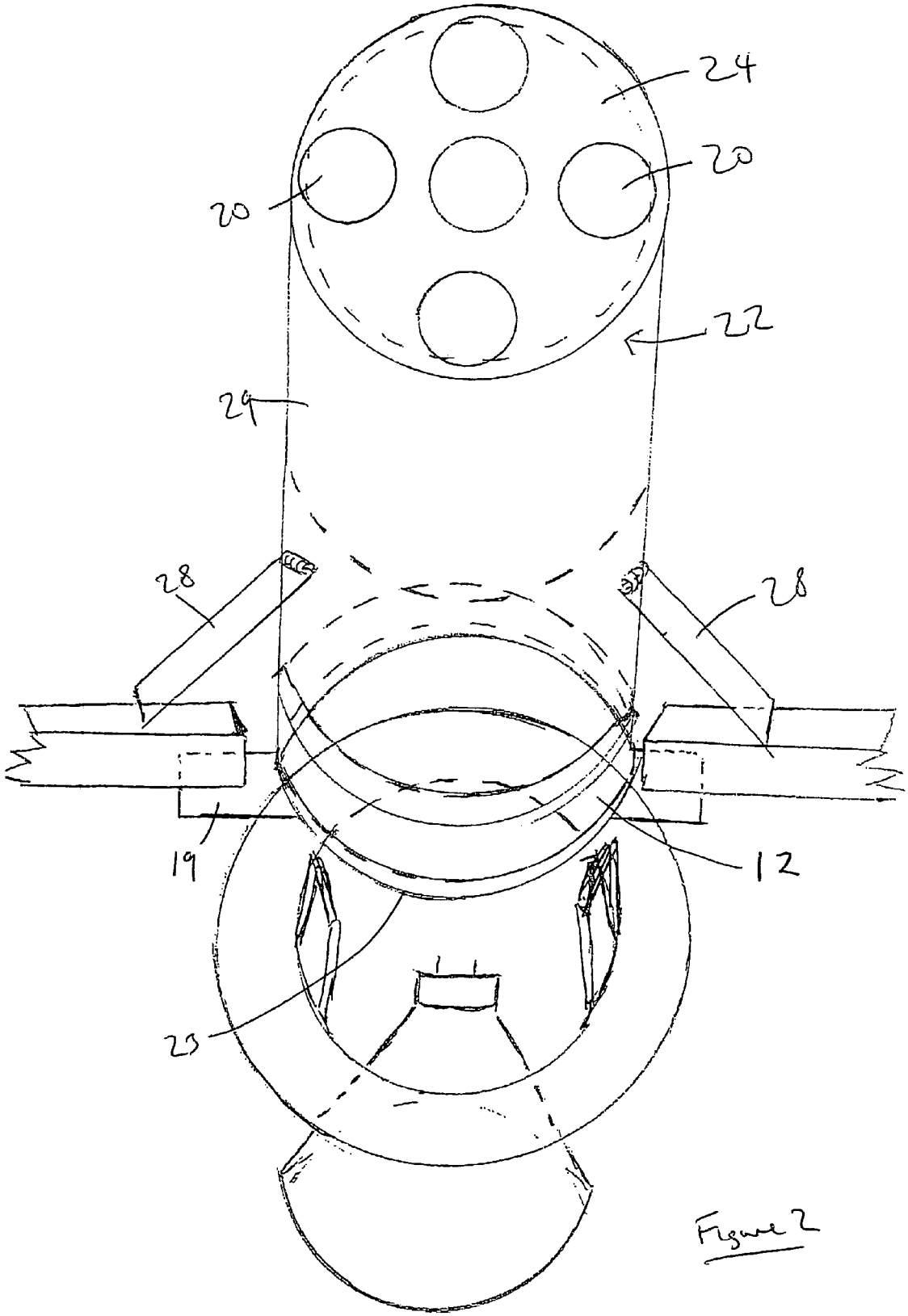
FIG. 2 illustrates a lighting assembly in accordance with the present invention in which an end of a hollow section is closed but incorporates ventilation holes.

As indicated above an open end 4 to the hollow section 2 may be advantageous in terms of allowing normal air flows for cooling of the light fitting 6. However, particularly when the hollow section 2 is integrally formed with the light fitting it will be understood that having an open end may allow dust and debris to fall into the light bulb. fitment and other fitting features. In such circumstances as illustrated in FIG. 2 a mainly closed end 24 of a hollow section 22 may be provided in which there are ventilation holes 20 to allow air flow for cooling but reducing the prospects for debris and dust to enter the hollow section 22 and therefore become incident upon light fitting components. As previously the hollow section 22 includes fixings 28 to enable location of the hollow section 22 and there is an open mounting end 23 which is associated and normally aligned with the mounting aperture inner surface in use. The hollow section 22 incorporates outward projections 19 which may as illustrated engage lower portions of the surface about the aperture in which the hollow section and therefore light fitting is secured. As previously the fixings 28 are generally sprung and biased so that the hollow section 22 is appropriately presented in normal use. In such circumstances the hollow section 22 is essentially presented in a similar fashion to that described with regard to hollow section 22 described with regard to FIG. 1.

In the embodiment depicted in FIG. 2 as previously an intumescent surface 29 extends in a band or collar along a proportion of the length of the hollow section 22. The width of the band or collar 29 will be dependent upon operational requirements in terms of closing of the hollow section and light fitting in use. As previously the intumescent surface 29 may be formed integrally with the hollow section 22 or more normally presented as separate elements secured through adhesives or mechanical bonding or otherwise to the hollow section 22. Once activated it will be appreciated that the expansion is substantially horizontal and across the hollow section 22 in order to close the holes 20 and so present a fire barrier. The hollow section 22 is again made from a fire resistant material.

In the embodiment depicted in FIG. 2 a further intumescent surface 12 is provided about a bottom edge of the hollow section 22. This intumescent 12 will typically be secured upon an external surface of the hollow section 22 and therefore will generally expand outwardly. As this intumescent surface 12 is on an outer surface and within the mounting aperture for the hollow section 22 in the surface it will be understood that this will close and create a fire barrier in the gap between the hollow section 22 and that mounting aperture. The intumescent surface 12 will also react to create a compressive seal against the projections 19 engaging the surface in order to provide a more robust barrier in use.

Figure 3:
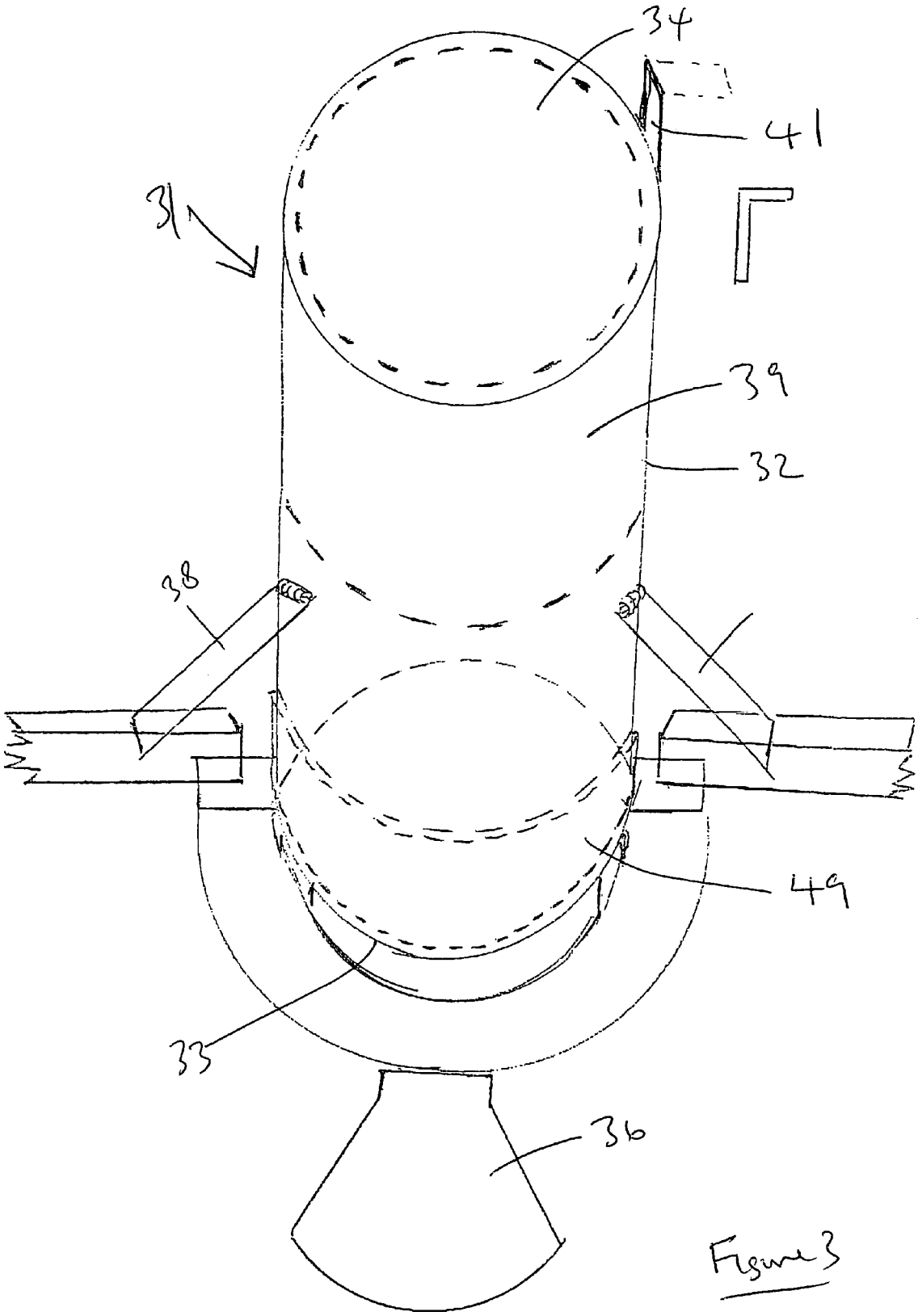
FIG. 3 illustrates a lighting assembly in accordance with the present invention in which an end is closed with an electrical terminal secured to the hollow section.

FIG. 3 illustrates a third embodiment of the present lighting assembly 31 in which for illustration purposes an end 34 is closed. As indicated previously such provision of a closed end 34 may present ventilation problems for cooling of a light fitting within a hollow section 32. Nevertheless, with low heat light assemblies it may be feasible to provide a closed assembly as depicted or ventilation may be achieved through apertures (not shown) at other positions in the hollow section 32. In any event, in terms of presenting a fire barrier it will be understood that the gap between the hollow section 32 and a mounting aperture in which the hollow section 32 and therefore light assembly is secured in a surface will be inadequate. In such circumstances as previously at a mounting end 33 a light fitting 36 will be provided and the assembly 31 secured appropriately in the surface for operational purposes through fixings 38. As previously intumescent surfaces 39 and 49 will be presented to act substantially horizontally when expanded across the hollow section 32 in order to close gaps and apertures in order to create an adequate fire barrier. The intumescent surface 39 as shown acts towards a top end of the hollow section 32 whilst the intumescent surface 49 is generally located externally to act against the fittings and projections to achieve a compressive seal with the intumescent material between the surface including the mounting aperture and the lighting assembly.

As indicated previously, a known or standard light fitting may be adapted into a lighting assembly in accordance with aspects of the present invention by provision of a hollow section 32 which sits over the existing fitting. In such circumstances in terms of installation the old light fitting will be removed from below and a hollow section 32 in accordance with the present invention pushed through the mounting aperture so that its fittings, (similar to those described with regard to FIGS. 1 and 2) are compressed to the sides of the hollow section 32 and then spring outwardly to engage the upper parts of the surface in which the mounting aperture is formed to retain position. It will be understood that a lower part, that is to say the edge incorporating the intumescent 49 may remain within the mounting aperture.

The hollow section 32 will incorporate tabs or other connectors 41 which allow electrical cabling and other wiring to be secured to the hollow section 32. The tab or coupling 41 itself is connected to wiring within the hollow section 32 at the end of which couplings for the electrical fitting 36 are provided. In such circumstances when the electrical fitting is inserted into the hollow section 32 that section 32 acts as a sleeve within which the lighting fitting is mounted and the light fitting electrical connections can be coupled to the hollow section 32 couplings for the tab 41 etc. In such circumstances the hollow section 32 provides and presents intumescent material which can close the lighting assembly in use when expanded.

An alternative method of installation simply requires removal of the lighting fitting 36 securing of the hollow section 32 as a sleeve over the fitting 36 and electrical couplings retained or made such that when the combination of the fitting 36 and the hollow section 32 is then presented and forced back through the mounting aperture., These fittings then return to their outwardly biased position in order to retain the assembly in place.

Figure 4:
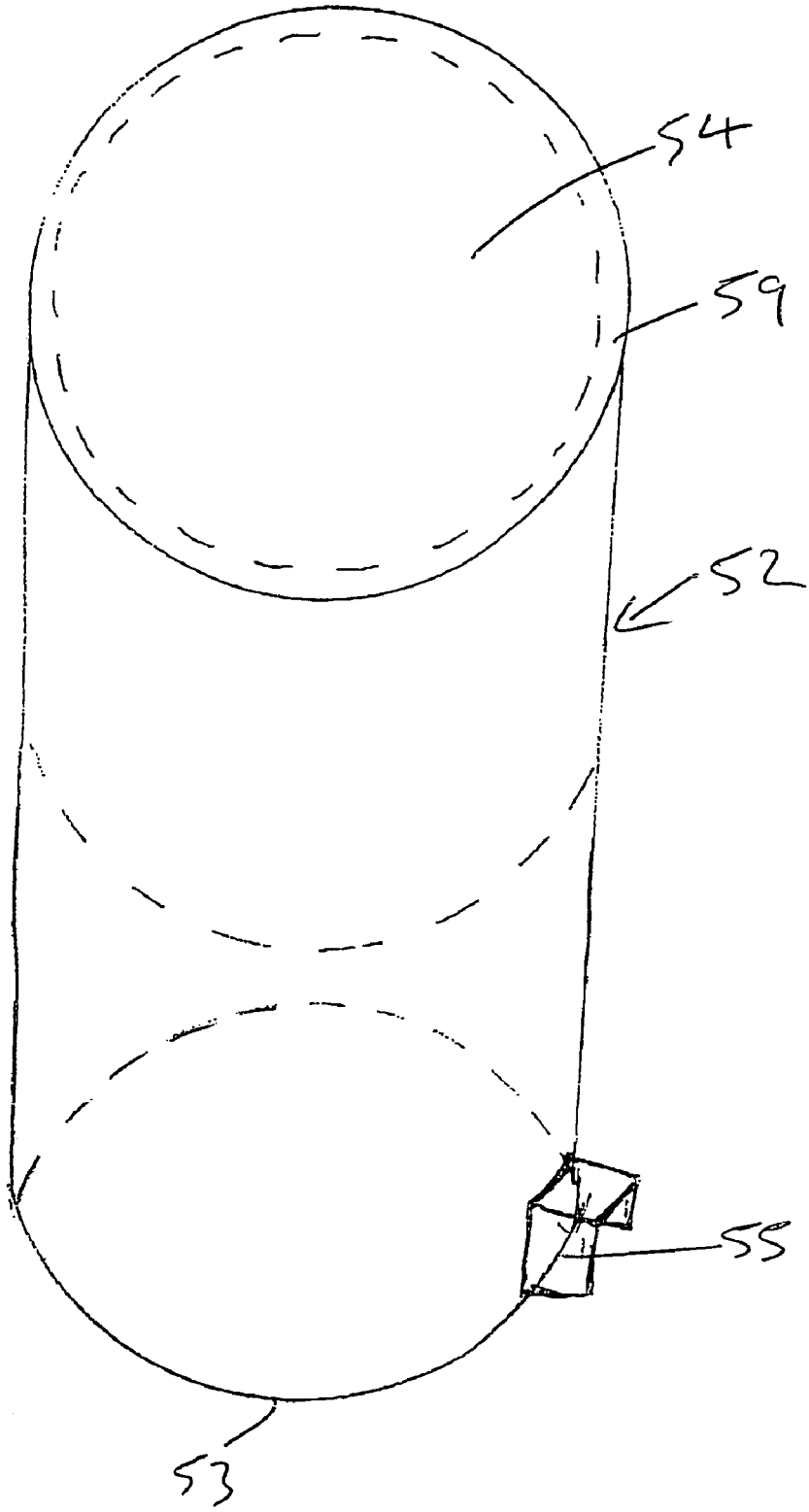
FIG. 4 illustrates a hollow section for securing about a light fitting or fitment.

As indicated above and shown in FIG. 4 a hollow insert 52 may be simply arranged as a cylinder or other cross-sectional shape to sit over a light fitting. The hollow insert 52 may be held in a compression or interference fit with a light fitting or simply as indicated overlay that light fitting. In such circumstances as previously the insert 52 has open ends 53, 54 with an intumescent layer 59 extending for a proportion of the length of the insert 52.

This intumescent layer surface 59 as indicated previously will expand substantially horizontally in order to close the open end 54 and therefore provide a fire rated barrier. At the bottom end of the insert 52 at the opening 53 typically a pathway in the form of an aperture or opening 55 is provided through which electrical cabling for a light fitting may be passed. This opening 55 will generally also incorporate an intumescent material in order to expand around the electrical cables and therefore provide a fire regulated barrier as described previously. It is also possible that the bottom end 53 extends down into a mounting aperture for the light fitting and therefore as described previously sections of the insert 52 towards the open end 53 may also incorporate intumescent surfaces to expand and therefore further seal around that mounting aperture.

The embodiment of the invention described in FIG. 4 can therefore be retro fit to an existing light fitment or fixing from above with the insert 52 simply resting over that fitting or fitment. The weight of the hollow section 52 will be sufficient to retain orientation and presentation to a light fitting in an assembly. In such circumstances fixings as described previously in order to retain position may not be required. It will be understood that such fittings were used where the hollow insert was pushed through either prior to or with the light fitting so that the outwardly sprung fixings retained hollow section orientation in use.

The hollow section can be made of a larger diameter to fit above the light fitting and to sit directly over the light fitting. Thus the hollow section will have an outside diameter which is greater than the mounting aperture for the light fitting and so will sit directly upon the upper surface of the ceiling or other structure in which the mounting aperture is presented for the light fitting.

As indicated above typically an opening or otherwise is provided for electrical cables. It will be appreciated that this opening as indicated may be hooded and the hood lined with intumescent material or simply a curved aperture presented in the hollow insert which is closed by intumescent material.

Normally the intumescent material will be secured to the normally upstanding inside or outside portions of the hollow section and therefore due to the nature of hot air rising upwards these sections will not have hot air lingering adjacent to them which may cause degradation. However, when there is a fire or hot air/smoke due to the nature of the chimney effect of the hollow insert 2 there will be more rapid presentation of hot air to the intumescent material causing swelling to close the hollow section as well as any holes or gaps in the lighting assembly.

Normally, the intumescent surface will be relatively planar and flat and therefore of a consistent thickness and cross-section. However, where appropriate the intumescent material may be shaped as a wedge for angular presentation of the intumescent material to take best advantage of the hot air flows through the chimney effect of the hollow insert. Furthermore, the intumescent surface may be located in a rebate groove pressed or otherwise formed into the hollow insert so that the intumescent surface can be appropriately presented for horizontal preferential expansion across the hollow insert. Alternatively, the intumescent surface may be presented upon a ridge which extends inwardly of the hollow insert for similar presentation of the intumescent layer to the hot air flows.

Modifications and alterations to the present invention will be appreciated by those skilled in the art. Thus, rather than a simple cylindrical shape the hollow insert may be waisted or have a rectangular or triangular or other geometric cross-sectional shape dependent upon circumstances.

It will be appreciated that the present lighting assembly may be utilised for mains or low voltage light fitments and fittings as the hollow insert may be formed integrally or secured to an existing light fitting. It will be understood that the conventional electrical connections for such fittings may be utilised and therefore the light fitting or fitment operated in its usual way.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A light assembly comprising a hollow section for a light element, the hollow section defining an interior space and including an intumescent surface presented upon the hollow section to expand upon activation across the interior space of the hollow section in directions substantially perpendicular to the hollow section.

2. An assembly as claimed in claim 1 wherein the intumescent surface comprises a layer of intumescent material secured to the hollow section.

3. An assembly as claimed in claim 1 wherein the intumescent surface is secured by an adhesive.

4. An assembly as claimed in claim 1 wherein the intumescent surface is secured by a mechanical fixing.

5. An assembly as claimed in claim 4 wherein the mechanical fixing comprises a rivet or screw or tape or stitching between the intumescent surface and the hollow section.

6. An assembly as claimed in claim 1 wherein the hollow section is formed from a fire resistant material.

7. An assembly as claimed in claim 6 wherein the fire resistant material is a metal or ceramic moulded or cast or otherwise formed to provide a hollow section.

8. An assembly as claimed in claim 1 wherein the intumescent surface comprises a collar within the hollow section.

9. An assembly as claimed in claim 8 wherein the hollow section incorporates more than one collar at axially displaced parts of the hollow section.

10. An assembly as claimed in claim 1 wherein the intumescent surface is formed in a rebate groove within the hollow section.

11. An assembly as claimed in claim 10 wherein the rebate groove aids horizontal expansion across the hollow section.

12. An assembly as claimed in claim 1 wherein the hollow section includes fixings to secure the hollow section about a mounting aperture in a surface.

13. An assembly as claimed in claim 12 wherein the fixings have a bias towards compressive engagement with the surface.

14. An assembly as claimed in claim 13 wherein the bias is provided by a spring.

15. An assembly as claimed in claim 13 wherein the fixings comprise interference clips outwardly expanding from the hollow section to engage the surface.

16. An assembly as claimed in claim 1 wherein the hollow section is open at both ends.

17. An assembly as claimed in claim 1 wherein the hollow section is closed at one end.

18. An assembly as claimed in claim 1 wherein the hollow section includes ventilation apertures.

19. An assembly as claimed in claim 1 wherein the intumescent surface is provided adjacent to any opening or aperture in the hollow section.

20. An assembly as claimed in claim 1 wherein the hollow section includes an intumescent feature provided upon an outside surface of the hollow section.

21. An assembly as claimed in claim 20 wherein the intumescent feature acts about the exterior of the hollow section upon expansion.

22. An assembly as claimed in claim 1 wherein the intumescent surface upon expansion acts against the bias, when present, to present a compressive seal barrier about the mounting aperture.

23. An assembly as claimed in claim 20 wherein the intumescent feature upon expansion acts against the resilience of a fixing to present a compressive seal about the mounting aperture.

24. An assembly as claimed in claim 20 wherein the intumescent feature is secured to or about a fixing.

25. An assembly as claimed in claim 1 wherein the hollow section is integral with a light fitting or fitment.

26. An assembly as claimed in claim 1 wherein the hollow section is secured around a light fitting or fitment.

27. An assembly as claimed in claim 1 wherein the hollow section has an interference association with a light fitting.

28. A hollow section for a lighting assembly, the hollow section defining an interior space and including an intumescent surface presented upon the hollow section to expand upon activation across the interior space of the hollow section in directions substantially perpendicular to the hollow section.

29. A section as claimed in claim 28 wherein the intumescent surface comprises a layer of intumescent material secured to the hollow section.

30. A section as claimed in claim 28 wherein the intumescent surface is secured by an adhesive.

31. A section as claimed in claim 28 wherein the intumescent surface is secured by a mechanical fixing.

32. A section as claimed in claim 31 wherein the mechanical fixing comprises a rivet or screw or tape or stitching between the intumescent surface and the hollow section.

33. A section as claimed in claim 28 wherein the hollow section is formed from a fire resistant material.

34. A section as claimed in claim 33 wherein the fire resistant material is a metal or ceramic moulded or cast or otherwise formed to provide a hollow section.

35. A section as claimed in claim 28 wherein the intumescent surface comprises a collar within the hollow section.

36. A section as claimed in claim 35 wherein the hollow section incorporates more than one collar at axially displaced parts of the hollow section.

37. A section as claimed in claim 36 wherein the intumescent surface is formed in a rebate groove within the hollow section.

38. A section as claimed in claim 37 wherein the rebate groove aids horizontal expansion across the hollow section.

39. A section as claimed in claim 28 wherein the hollow section includes fixings to secure the hollow section about a mounting aperture in a surface.

40. A section as claimed in claim 39 wherein the fixings have a bias towards compressive engagement with the surface.

41. A section as claimed in claim 40 wherein the bias is provided by a spring.

42. A section as claimed in claim 39 wherein the fixings comprise interference clips outwardly expanding from the hollow section to engage the surface.

43. A section as claimed in claim 28 wherein the hollow section is open at both ends.

44. A section as claimed in claim 28 wherein the hollow section is closed at one end.

45. A section as claimed in claim 28 wherein the hollow section includes ventilation apertures.

46. A section as claimed in claim 28 wherein the intumescent surface is provided adjacent to any opening or aperture in the hollow section.

47. A section as claimed in claim 28 wherein the hollow section includes an intumescent feature provided upon an outside surface of the hollow section.

48. A section as claimed in claim 47 wherein the intumescent feature acts upon expansion about the exterior of the hollow section.

49. A section as claimed in claim 28 wherein the intumescent surface upon expansion acts against the bias, when present, to present a compressive seal barrier.

50. A section as claimed in claim 48 wherein the intumescent feature upon expansion acts against the resilience of a fixing to present a compressive seal.

51. A section as claimed in claim 48 wherein the intumescent feature is secured to or about a fixing.

52. A section as claimed in claim 28 wherein the hollow section is integral with a light fitting or fitment.

53. A section as claimed in claim 28 wherein the hollow section is secured around a light fitting or fitment.

54. A section as claimed in claim 28 wherein the hollow section has an interference association with a light fitting.

55. An assembly as claimed in claim 1, wherein the hollow section is substantially cylindrical and has an interior surface, the intumescent surface comprises a layer of intumescent material secured to the hollow section at the interior surface thereof, and the intumescent material expands upon activation radially inwardly with respect to the hollow section.

* * * * *